United States Patent [19]

Aotsuka et al.

[11] Patent Number: 4,784,931

[45] Date of Patent: Nov. 15, 1988

[54] METHOD FOR FORMING DYE TRANSFER IMAGE USING AMPHOTERIC SURFACE ACTIVE AGENT

[75] Inventors: Yasuo Aotsuka; Masakazu Yoneyama; Hideki Naito, all of Kanagawa, Japan

[73] Assignee: Fuji Photo Film Co., Ltd., Kanagawa, Japan

[21] Appl. No.: 12,465

[22] Filed: Feb. 9, 1987

[30] Foreign Application Priority Data

Feb. 7, 1986 [JP] Japan ..... 61-24113
Jul. 23, 1986 [JP] Japan ..... 61-171680

[51] Int. Cl.[4] ..... G03C 5/54; G03C 1/90
[52] U.S. Cl. ..... 430/203; 430/259
[58] Field of Search ..... 430/203, 259

[56] References Cited

U.S. PATENT DOCUMENTS 4,500,626 2/1985 Naito et al. ..... 430/203
4,529,683 7/1985 Bishop ..... 430/259
4,550,071 10/1985 Aono et al. ..... 430/203
4,665,005 5/1987 Aono et al. ..... 430/203
4,704,345 11/1987 Hirai et al. ..... 430/203

*Primary Examiner*—Richard L. Schilling
*Attorney, Agent, or Firm*—Sughrue, Mion, Zinn, Macpeak, and Seas

[57] ABSTRACT

A method for forming an image comprising heating a light-sensitive element in the presence of water and at least one of a base and a base precursor after or simultaneously with imagewise exposure to light thereof, said light-sensitive element comprising a support having provided thereon a light-sensitive layer comprising a light-sensitive silver halide emulsion, a binder, and a dye providing substance which forms or releases a diffusible dye upon heating, and transferring said diffusible dye thus formed or released to a dye fixing layer of a dye fixing element, wherein at least one of said light-sensitive element and said dye fixing element contains an amphoteric surface active agent.

8 Claims, No Drawings

METHOD FOR FORMING DYE TRANSFER IMAGE USING AMPHOTERIC SURFACE ACTIVE AGENT

BACKGROUND OF THE INVENTION

The present invention relates to a method for forming an image, and more particularly to a method for forming an image by heat development.

A photographic method using silver halide has been most widely used because this method results in excellent in photographic characteristics such as sensitivity and gradation control as compared with other photographic methods, such as an electrophotographic method and a diazo photographic method. In recent years, a technique permitting easy and rapid formation of images in the image-forming processing of light-sensitive materials using silver halide has been developed in which dry processing, such as heating, is employed in place of wet processing, such as a processing using a developer.

Photographic materials to be processed by the above image-forming method including a combination of heat developable color light-sensitive element comprising light-sensitive silver halide and a dye providing substance forming or releasing a hydrophilic diffusible dye, and a dye-fixing element to transfer and fix therein the diffusible dye in the presence of a small amount of water, as described in Japanese Patent Application (OPI) Nos. 58432/83 and 218443/84 (the term "OPI" as used herein means a "published unexamined patent application").

During dry processing by the above heat development method, water is supplied in a constant amount not more than the absorption amount of the coating at the time of maximum swelling as described in Japanese Patent Application (OPI) No. 238056/86. Therefore, certain advantages result such as a reduction in the mechanical strength of the coating due to the softening treatment of the coating which is carried out in order to facilitate the permeation of a developer in a conventional wet processing step; and a shrinkage of the coating (reticulation) at the drying step after processing do not occur.

In the heat development dry processing, however, it is necessary that the processing be carried out in the presence of a small amount of water. Since photographic performance varies with the amount of water supplied, a constant performance in terms of photographic characteristics cannot be obtained unless the amount of water supplied is made constant.

Another problem occurring in these types of conventional systems is that when a light-sensitive element is peeled apart from a dye-fixing element after the development and dye diffusion transfer in the presence of a constant amount of water, either all or a part of the coating of the light-sensitive element is bonded together with the coating of the dye-fixing element and cannot be peeled apart with ease. Furthermore, if the light-sensitive element is forcibly peeled apart from the dye-fixing element, the coating is peeled apart, causing damage or contamination of the peeled surface and thus no satisfactorily sharp image can be obtained.

Still another problem is that when the dye-fixing element is used in heat development after being stored under low humidity conditions, "white dots" (transfer unevenness, i.e., localized missing of transferred dye) is observed in the image.

A technique to obtain an image having an improved S/N ratio by increasing the effective activity of development and transfer has been desired.

SUMMARY OF THE INVENTION

An object of the present invention is to provide a method for forming an image whereby:

(1) dependence of photographic performance on the amount of water supplied at the time of heat development is reduced;

(2) peeling properties of a light-sensitive element from a dye-fixing element after heat development and dye diffusion transfer are improved;

(3) formation of undesirable white dots as observed at low humidity storage is prevented;

(4) coating properties of the light-sensitivity element and dye-fixing element are improved; and (5) images having an improved S/N ratio can be obtained.

The above and other objects of the present invention are realized by a method for forming an image white comprises heating a light-sensitive element in the presence of water and at least one of a base and a base precursor (abbreviated "a base and/or a base precursor" hereinafter) after or simultaneously with imagewise exposure to light thereof, said light-sensitive element comprising a support having provided thereon a light-sensitive layer comprising a light-sensitive silver halide emulsion, a binder, and a dye providing substance which forms or releases a diffusible dye upon heating, and transferring said diffusible dye thus formed or released to a dye fixing layer of a dye fixing element, wherein at least one of said light-sensitive element and said dye fixing element contains an amphoteric surface active agent.

DETAILED DESCRIPTION OF THE INVENTION

The amphoteric surface active agent as used herein means a surface active agent having both of an anionic group and a cationic group in the molecule thereof and forming an intramolecular salt, and can be represented by formula (D)

$$A^{\ominus}—C^{\oplus} \qquad (D)$$

wherein $A^{\ominus}$ represents an anionic moiety containing an anionic group such as a sulfonic acid group, a carboxylic acid group and a phosphoric acid group, and $C^{\oplus}$ represents an organic cationic moiety.

It is preferred that the amphoteric surface active agent as used herein contains at least one unsubstituted or fluorine-substituted saturated or unsaturated hydrocarbon group having 6 or more carbon atoms. Particularly preferably, the amphoteric surface active agent as used herein contains at least one unsubstituted or fluorine-substituted saturated or unsaturated hydrocarbon group having from 10 to 24 carbon atoms.

Representative examples of the amphoteric surface active agent as used herein as shown below, however, these compounds are not intended to limit the scope of the present invention in any manner.

1. $C_{13}H_{27}CONHCH_2CH_2CH_2-\overset{\oplus}{N}(CH_3)_2-CH_2COO^{\ominus}$

2. $C_{17}H_{35}CONHCH_2CH_2CH_2-\overset{\oplus}{N}(CH_3)_2-CH_2COO^{\ominus}$

3. $C_{21}H_{43}CONHCH_2CH_2CH_2-\overset{\oplus}{N}(CH_3)_2-CH_2COO^{\ominus}$

4. $C_{15}H_{31}CONHCH_2CH_2CH_2-\overset{\oplus}{N}(CH_3)_2-CH_2COO^{\ominus}$

5. $C_{15}H_{31}CONHCH_2CH_2CH_2-\overset{\oplus}{N}(CH_3)_2-CH_2CH_2CH_2CH_2SO_3^{\ominus}$ 6. $C_{17}H_{35}CONHCH_2CH_2CH_2OCH_2CH_2-\overset{\oplus}{N}(CH_3)_2-CH_2COO^{\ominus}$ 7. $C_{16}H_{33}OCH_2CH(OH)CH_2-\overset{\oplus}{N}(CH_2OH)(CH_2COO^{\ominus})-CH_2OH$ 8. $C_{14}H_{29}OCH_2CH(OH)CH_2-\overset{\oplus}{N}(CH_3)(CH_2COO^{\ominus})-CH_3$ 9. $C_{12}H_{25}-\overset{\oplus}{N}(CH_3)_2-CH_2CH_2CH_2SO_3^{\ominus}$ 10. $C_{14}H_{29}-\overset{\oplus}{N}(CH_3)_2-CH_2COO^{\ominus}$ 11. $C_{18}H_{37}-\overset{\oplus}{N}(CH_3)_2-CH_2COO^{\ominus}$ 12. $(C_{12}H_{25})_2\overset{\oplus}{N}(CH_3)(CH_2COO^{\ominus})$ 13. 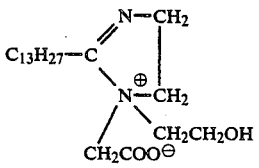

14. $C_{12}H_{25}NHCH_2CH_2COOH$

15. $C_{18}H_{37}NHCH_2CH_2NHCH_2CH_2NHCH_2COOH$

-continued

16. $H(C_2F_4)_4CONH-(CH_2)_3-\overset{\oplus}{N}(CH_3)_2-(CH_2)_4SO_3^{\ominus}$ 17. $C_8F_{17}CONH(CH_2)_3-\overset{\oplus}{N}(CH_3)_2-CH_2COO^{\ominus}$ 18. $C_8F_{17}SO_2NH-(CH_2)_3OCH_2CH_2-\overset{\oplus}{N}(CH_3)_2-CH_2COO^{\ominus}$ 19. $C_8F_{17}SO_2NH(CH_2)_3-\overset{\oplus}{N}(CH_3)_2-CH_2COO^{\ominus}$ 20. 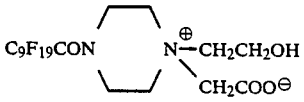

21. 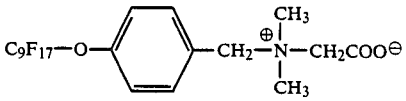

22. $C_{14}H_{29}SO_2NH-(CH_2)_3-\overset{\oplus}{N}(CH_3)_2-CH_2COO^{\ominus}$

23. $CH_2OCOC_{14}H_{29}$
$CHOCOC_{14}H_{29}$
$CH_2O\overset{O}{\overset{\|}{P}}(O^{\ominus})OCH_2CH_2\overset{\oplus}{N}(CH_3)_3$ 24. $C_{11}H_{23}CONHCH_2CH_2CH_2-\overset{\oplus}{N}(CH_3)_2-CH_2COO^{\ominus}$ The above-described objects of the present invention can be attained as long as at least one of the light-sensitive element and the dye-fixing element contains the above amphoteric surface active agent. In order to prevent the formation of white dots as observed when the light-sensitive element is stored under low humidity conditions, it is preferred to incorporate the amphoteric surface active agent in the dye-fixing element. The exact layer in which the amphoteric surface active agent is to be incorporated is not critical. Two or more kinds of the amphoteric surface active agents can be incorporated in the same layer or different layer.

The amount of the amphoteric surface active agent used is about 0.001 $g/m^2$ or more, preferably from 0.005 to 5 $g/m^2$ relative to the photographic element in which the amphoteric surface active agent is incorporated (i.e., the light-sensitive element, the dye-fixing element, or both). This is because many of the amphoteric surface active agents are diffusible. From a viewpoint of improving peeling properties, it is preferred that the amphoteric surface active agent be added to a coating solution for preparation of the uppermost layer of the light-sensitive element and/or the dye-fixing element.

The photographic element of the present invention generally comprises a light-sensitive element forming or releasing a dye upon heat development and a dye-fixing element in which the dye is to be fixed. Typically, this type of photographic element can be divided into two groups; (1) a light-sensitive element and a dye-fixing element are separatedly formed on two supports, and (2) a light-sensitive element and a dye-fixing element are formed on the same support.

In the case of embodiment in which the light-sensitive element and the dye fixing element are formed on different supports, a coated surface of the light-sensitive element and a coated surface of the dye fixing element are superposed on each other after imagewise exposure or heat development, and then after formation of transferred images the light-sensitive element is peeled apart from the dye fixing element. A support of the dye fixing element is selected from an opaque support and a transparent support depending on the fact that whether the final image is a reflective type or a transmitting type. Further, a white reflective layer may be provided on the support, if desired.

U.S. Pat. No. 4,500,626 and Japanese Patent Application (OPI) No. 147244/86 adequately describe the relationship between the light-sensitive element and the dye-fixing element, the relationship between the light-sensitive element or dye-fixing element and the support, and the relationship between the light-sensitive element and dye-fixing element and a white reflection layer.

An example of the embodiment in which the light-sensitive element and the dye-fixing element are formed on the same support is that it is not necessary to peel the light-sensitive element from the dye-fixing element after formation of a transferred image. In this embodiment, a light-sensitive layer, a dye-fixing layer and a white reflection layer are laminated on a transparent or opaque support. For example, a transparent support/light-sensitive layer/white reflection layer/dye-fixing layer structure, and a transparent support/dye-fixing layer/white reflection layer/light-sensitive layer are preferred.

Other typical embodiments of the structure in which the light-sensitive element and the dye-fixing element are formed on the same support are described, for example, in Japanese Patent Application (OPI) No. 67840/81, Canadian Pat. No. 674,082 and U.S. Pat. No. 3,730,718, in which all or a part of the light-sensitive element is peeled apart from the dye-fixing element and a peeling layer is provided at a suitable position.

The photographic element of the present invention also includes an embodiment in which the light-sensitive element or dye-fixing element has an electrically conductive heat generation layer as heating means for heat development or diffusion transfer of dyes. In this case, the transparent or opaque heat generation element can be prepared as a resistance heat generator by conventionally known techniques.

The resistance heat generator can be produced by a method utilizing a thin film of a semiconductive inorganic material and a method utilizing a thin organic film in which electrically conductive fine particles are dispersed in a binder. The materials described, for example, in Japanese Patent Application (OPI) No. 29835/86 can be utilized in these methods.

Binders used in the dye-fixing element and the light-sensitive element, particularly binders for use in a layer in which the amphoteric surface active agent is to be incorporated, are preferably hydrophilic. Typical examples thereof include transparent or translucent hydrophilic colloids, such as a natural substances, e.g., proteins such as gelatin and gelatin derivatives, polysaccarides such as cellulose derivatives and starch, and synthetic polymers, e.g., dextran, pulluran, water-soluble polyvinyl compounds such as polyvinyl alcohol, polyvinyl pyrrolidone and acrylamide polymers. Particularly effective are gelatin and polyvinyl alcohol.

In accordance with one embodiment of the method for forming an image of the present invention, the light-sensitive element is heated in the presence of water and a base and/or a base precursor after or simultaneously with imagewise exposure to light thereof, the dye formed or released is transferred to the dye-fixing layer of the dye-fixing element simultaneously with development by heating, and then the light-sensitive element is peeled apart from the dye-fixing element, whereupon a color image is formed in the dye-fixing element.

In the present invention, water is used for acceleration of development and/or transfer of the diffusible dye to the dye-fixing layer. Water may be supplied to either the dye-fixing element or the light-sensitive element. In addition, water may be supplied to both the light-sensitive element and the dye-fixing element.

In the present invention, water may be supplied in any manner which is commonly used. For example, water may be jetted through fine holes, or may be applied with a web roller. In addition, a method in which pots containing water are collapsed may be employed. However, the present invention is not limited to these methods for supplying water.

When water is applied between the light-sensitive layer of the heat developable light-sensitive element and the dye-fixing layer of the dye-fixing element, water accelerators the formation of image and/or the transfer of dyes. Water can be previously incorporated in the light-sensitive element or the dye-fixing element, or both, in the form of, e.g., water of crystallization and microcapsules.

The water as used herein is not limited to pure or distilled water, and includes water in the sense widely and conventionally used in this field of art. That is, an aqueous solution containing the base and/or the base precursor as described hereinafter or compounds capable of reacting with metal ions to form complex salts can be used, or a mixed solvent comprising water and low boiling point solvents such as methanol, dimethyl formamide (DMF), acetone and diisobutyl ketone can be used. In addition, an aqueous solution containing an auxiliary dye-releasing agent, an accelerator and a hydrophilic heat solvent as described hereinafter can be used.

The amount of water used in the present invention is at least about 0.1 times the weight of all layers comprising the light-sensitive and dye-fixing elements, and preferably is in the range of from 0.1 time the weight of all the layers to the weight of water corresponding to the maximum swelling volume of all the layers, and more preferably 0.1 time the weight of all the layers to the value after subtracting the weight of all the layer from the weight of water corresponding to the maximum swelling volume of all the coated layers.

In the present invention, the dependence of photographic performance on the amount of water supplied can be reduced by incorporating the present amphoteric surface active agent in the dye-fixing element. However the state of the layers at the time of swelling is unstable, and depending on conditions, local stains are often formed. In order to eliminate this problem, it is preferred that water be added in an amount not more than that corresponding to the volume at the maximum swelling point of all the layers of the light-sensitive and dye-fixing elements.

The base and/or base precursor as used herein can be incorporated in the light-sensitive element or the dye-fixing element. The base and/or base precursor can also be used in an aqueous state, i.e., dissolved in water.

Examples of the base of the present invention include inorganic bases (such as hydroxides, secondary or tertiary phosphates, borates, carbonates, quinolinate, metaborates of alkali metals and alkaline earth metals; ammonium hydroxide; the hydroxide of quaternary alkylammonium; and other metal hydroxides), organic bases (such as aliphatic amines (trialkylamines, hydroxylamines and aliphatic polyamines); aromatic amines (N-alkyl-substituted amines, N-hydroxylalkyl-substituted aromatic amines and bis[p-(dialkylamino)-phenyl]methanes), heterocyclic amines, amidines, cyclic amidines, guanidines, cyclic guanidines), and so forth. Basic compounds having a pKa of not less than 8 are particularly preferred.

Salts of the above organic bases and weak acids, such as carbonates, hydrogencarbonates, borates, phosphates or phosphites, quinolinates, acetates, metaborates, etc. are preferably used. In addition, compounds described in Japanese Patent Application (OPI) No. 218443/84 are also preferred.

Examples of the base precursor include salts of organic acids and bases which decompose with decarbonization upon heating, compounds releasing amines upon decomposition through reactions such as intramolecular nuclear substitution reaction, the Lossen rearrangement, and the Beckmann rearrangement, other compounds releasing a base through any reaction upon heating, and compounds releasing a base through electrolysis. Preferred examples of the base precursor which generates a base upon heating include salts of trichloroacetic acid as described in British Pat. No. 998,949, salts of α-sulfonylacetic acid as described in U.S. Pat. No. 4,060,420, salts of propiolic acid as described in Japanese Patent Application (OPI) No. 180537/84, 2-carboxycarboxamide derivatives as described in U.S. Pat. No. 4,088,496, salts of heat-decomposable acids with alkali metals and alkaline earth metals as well as organic bases as the base component as described in Japanese Patent Application (OPI) No. 195237/84, hydroxame carbamates in which the Lossen rearrangement is utilized as described in Japanese Patent Application (OPI) No. 168440/84, and aldoxymcarbamates forming nitrile on heating as described in Japanese Patent Application (OPI) No. 157637/84. In addition, base precursors as described in British Pat. No. 998,945, U.S. Pat. No. 3,220,864, Japanese Patent Application (OPI) No. 22625/75 and British Pat. No. 2,079,480 are useful.

Hereinafter, compounds forming a base upon hydrolysis are described.

A typical example of a method using electrolytic oxidation is electrolysis of various fatty acid salts. By this reaction, carbonates of alkali metals and organic bases such as guanidines and amidines can be obtained quite efficiently.

Methods utilizing electrolytic reduction include formation of amines through reduction of nitro and nitroso compounds, formation of amines through reduction of nitriles, and formation of p-aminophenols, p-phenylenediamines and hydrazines through reduction of nitro compounds, azo compounds, azoxy compounds, etc. p-Aminophenols, p-phenylenediamines and hydrazines can be used not only as bases, but also directly as color image-forming substances.

Of course, the formation of an alkali component by electrolysis of water in the presence of various inorganic salts can be utilized.

In addition to the above-described methods, other various methods for formation of bases can be used. Examples include a method in which bases are formed by mixing sparingly water-soluble basic metal compounds and compounds capable of reacting with the metal ions constituting the sparingly water-soluble basic metal compound to form a complex (called "complex-forming compounds"), and a method as described in Japanese Patent Application (OPI) No. 232451/86 in which bases are formed by electrolysis. Any of compounds used in the method are all useful as base precursors.

In particular, the former method is effective in the present invention. Examples of the sparingly water-soluble basic metal compounds include the carbonates, hydroxides and oxides of zinc, aluminum, calcium, barium and the like. The complex-forming compounds are described in detail, for example, in A.E. Martell & R.M. Smith, *Critical Stability Constants,* Vols. 4 and 5, Plenum Press. Representative examples include the salts of aminopolycarboxylic acids, imidoacetic acids, pyridylcarboxylic acids, aminophosphoric acids, carboxylic acids (mono-, di-, tri- and tetracarboxylic acids and those having substituents such as a phosphono group, a hydroxy group, an oxo group, an ester group, an amide group, a mercapto group, an alkylthio group and a phosphino group), hydroxamic acids, polyacrylates, polyphosphoric acids, and alkali metals, guanidines, amidines or quaternary ammonium salts.

It is advantageous for the sparingly water-soluble basic metal compound and the complex-forming compound to be added separatedly to the light-sensitive element and the dye-fixing element.

The base and/or the base precursor can be used alone or in combination of two or more thereof.

The base and/or base precursor as used herein can be used in a wide-ranging amounts. For example, where the base and/or base precursor is incorporated in the light-sensitive layer and/or the dye-fixing layer, the base and/or base precursor may be present in an amount of not more than about 50 wt% based on the weight of the coated amount of each layer. The range of from 0.01 to 40 wt% based on the coated amount of each layer is more preferred. On the other hand, where the base and/or base precursor is used as an aqueous solution, the concentration is preferably from about 0.005 to about 2 mol/l and more preferably from 0.05 to 1 mol/l. This addition amount has no direct relation with the pH of the layers since if the base and/or base precursor are superposed on the dye-fixing element, they transfer to another layer.

In the present invention, heat is applied at the development step. Since in the present invention, a relatively large amount of water is used as the solvent, the maximum temperature to which the light-sensitive material can be heated is determined by the boiling point of an aqueous solution in the light-sensitive element (i.e., in which various additives are dissolved in water added).

Heating means may comprise a heat generation plate or similar means, utilizing, for example, a hot plate, an iron, a heat roller and carbon and titanium white.

An electrically conductive heat generator layer may be provided in the light-sensitive element or the dye-fixing element as the heating means for heat development and diffusion transfer of dyes.

In connection with pressure under which the light-sensitive sensitive element and the dye-fixing element are superposed and brought into close contact and a method of applying pressure, the methods described in Japanese Patent Application (OPI) No. 147244/86 can be used.

After heat development and dye diffusion, the light-sensitive element and the dye-fixing element are peeled part from each other if necessary. This can be easily carried out in the present invention. This operation can be carried out by hand or by the use of conventional devices as described in Japanese Patent Publication Nos. 5 474/67, 5676/66, 1354/70 and 29713/78, and Japanese Patent Application (OPI) No. 135944/85.

As silver halides which can be used in the present invention include any of silver chloride, silver bromide, silver chlorobromide, silver chloroiodide and silver chloroiodobromide.

More specifically, any of the silver halide emulsions as described in Japanese Patent Application (OPI) No. 107240/86, U.S. Pat. No. 4,500,626, and *Research Disclosure,* RD No. 17029, pp. 9 to 10 (June 1978) can be used.

The silver halide emulsions may be used without ripening. Usually, the silver halide emulsion is subjected to chemical sensitization by, for example, conventional methods such as the sulfur sensitization method, the reduction sensitization method and the noble metal sensitization method. These methods may be used alone or in combination with each other. These chemical sensitization methods can be carried out in the presence of nitrogen-containing heterocyclic compounds as described in Japanese Patent Application (OPI) Nos. 126526/83 and 215644/83.

The silver halide emulsion as used herein may comprise the surface latent image type in which a latent image is mainly formed on the particle surface, or may comprise the internal latent image type in which a latent image is mainly formed inside the particle. A direct reversal emulsion in which a internal latent image type emulsion and a nucleating agent are used in combination can also be used.

The amount of the light-sensitive silver halide as coated in the present invention is in the range of from about 1 mg to about 10 g/m$^2$ based on the weight of silver.

In the present invention, an organic metal salt can be used as an oxidizing agent in combination with the light-sensitive silver halide emulsion. In this case, it i s necessary for the light-sensitive silver halide emulsion and the organic metal salt to be placed in contact with each other or in close proximity.

Of these organic metal salts, organic silver salts are particularly preferred.

Organic compounds which can be used to form the above organic silver salt oxidizing agent include the compounds described in Japanese Patent Application (OPI) No. 107240/86, and U.S. Pat. No. 4,500,626. In addition, the silver salts of carboxylic acids having an alkynyl group, such as silver phenylpropionate as described in Japanese Patent Application (OPI) No. 113235/85 are useful.

These organic silver salts can be used in combination in an amount of from about 0.01 to about 10 mol, preferably from 0.01 to 1 mol per mol of light-sensitive silver halide. The total amount of silver halide and organic silver salt coated is preferably from about 50 mg to about 10 g/m$^2$ as fsilver.

The silver halide as used herein may be subjected to spectral sensitization using, e.g., methine dyes and the like. Dyes which can be used include cyanine dyes, merocyanine dyes, composite cyanine dyes, composite merocyanine dyes, holopolar cyanine dyes, hemicyanine dyes, styryl dyes, and hemioxonol dyes.

More specifically, the sensitizing dyes described in Japanese Patent Application (OPI) Nos. 180550/84, 140335/85, and Research Disclosure, RD No. 17029, pp. 12 to 13 (June 1968), and sensitizing dyes having heat-discoloration properties as described in Japanese Patent Application (OPI) No. 111239/85 can be used.

These sensitizing dyes can be used alone or in combination with each other. Such combinations of sensitizing dyes are often used for the purpose of supersensitization.

In combination with such sensitizing dyes, dyes not having a spectral sensitization function by themselves or substances not substantially absorbing visible light but exhibiting supersensitization may be incorporated in the emulsions. These dyes and substances are described, for example, in U.S. Pat. Nos. 2,933,390, 3,635,721, 3,743,510, 3,615,613, 3,615,641, 3,617,295 and 3,635,721.

These sensitizing dyes may be added to the emulsion at the time of chemical ripening or after or before chemical ripening. In addition, they may be added before or after formation of nuclei of silver halide particles according to U.S. Pat. Nos. 4,183,756 and 4,225,666.

The amount of the sensitizing dye added is generally from about $10^{-8}$ to about $10^{-2}$ mol per mol of silver halide.

In the present invention, a compound forming or releasing a mobile dye corresponding to or countercorresponding to the reduction of silver ion to silver, i.e., a dye providing substance is incorporated.

The dye providing substance will hereinafter be explained.

An example of the dye providing substance which can be used in the present invention is a coupler capable of reacting with a developer. In this system utilizing such couplers, an oxidized product of the developer (which results from the redox reaction of the silver salt and the developer) reacts with the coupler, thereby forming a dye. This system is described in a number of literature references listed hereinafter. The coupler may be 4-equivalent or 2-equivalent. In addition, 2-equivalent couplers having an anti-diffusing group in a releasing group and forming a diffusible dye on reacting with the oxidized developer are preferred. Representative examples of the developer and the coupler are described in detail in, for example, T. H. James, *The Theory of the Photographic Process, pp.* 291 to 334, pp. 354 to 361, Japanese Patent Application (OPI) Nos. 124533/83, 149046/83, 149047/83, 111148/84, 124399/84, 174835/84, 341539/84, 231540/84, 2950/85, 2951/85, 14242/85, 23474/85 and 66249/85.

Other examples of the dye providing substance are dye silver compounds resulting from bonding of organic silver salts and dyes. Representative examples of such dye silver compounds are described, for example, in *Research Disclosure,* RD No. 16966, pp. 54 to 58 (May 1978).

Other examples of the dye providing substance are azo dyes which are used in the heat development silver dye bleaching method. Representative examples of the azo dye and the method for bleach are described in *Research Disclosure,* RD No. 14433, pp. 30 to 32 (april 1976). Other examples of the dye providing substance are leuco dyes described, for example, in U.S. Pat. Nos. 3,985,565 and 4,022,617.

Still other examples of the dye providing substance are compounds having an ability to imagewise release or diffuse a diffusible dye. The compounds of this type can be represented by formula (LI)

$$(\text{Dye—X})_n\text{Y} \qquad \text{(LI)}$$

In formula (LI), Dye represents a dye group, a dye group temporarily shifted to a short wavelength, or a dye precursor group, X represents a chemical bond or a connecting group, Y represents a group imparting a difference in diffusibility to the compound represented by $(\text{Dye-X})_n\text{Y}$ corresponding to or countercorresponding to a light-sensitive silver salt having an imagewise latent image, or releasing Dye, thus forming a difference in diffusibility between the released Dye and $(\text{Dye-X})_n\text{Y}$, n represents 1 or 2, and when n is 2, the two Dye-X groups may be the same or different.

Representative examples of the dye providing substance represented by formula (LI) include dye developers comprising a hydroquinone developer and a dye component bonded together as described, for example, in U.S. Pat. Nos. 3,134,764, 3,362,819, 3,597,200, 3,544,545, and 3,482,972 Substances releasing a diffusible dye through the intramolecular nucleophilic substitution reaction are described in Japanese Patent Application (OPI) No. 63618/76. Substances releasing a diffusible dye through the intramolecular rewinding reaction of an isooxazolone ring are described in Japanese Patent Application (OPI) No. 111628/74. In each of these systems, a diffusible dye is formed or diffused in an area where development does not occur, on the other hand, in areas where development occurs, no diffusible dye is formed or released.

The compounds described in U.S. patent application Ser. No. 925,350 (filed Oct. 30, 1986) can be used which release a diffusible dye according to the same mechanism as above. These compounds provide a diffusible dye as a result of cleavage of an N-O bond by the residual reducing agent.

As another system, a system can be used in which a dye releasing compound has been converted into an oxidized form not capable of releasing a dye, and is allowed to coexist with a reducing agent or its precursor. After development, the oxidized compound is reduced with the residual reducing agent remaining unoxidized and thus becomes able to release a diffusible dye. Representative examples of dye providing substances which are used in this system are described in Japanese Patent Application (OPI) Nos. 110827/78, 130927/79, 164342/81 and 35533/78.

Substances a diffusible dye in an area where development occurs include substances releasing a diffusible dye upon reaction of a coupler having a diffusible dye as a releasing group and an oxidized developer, as described in British Pat. No. 1,330,524, Japanese Patent Publication No. 39165/73 and British Pat. No. 3,443,940.

In addition, for the purpose of overcoming the problem that an image is contaminated by oxidation decomposition products of the developer as encountered in a system using a color developer, dye releasing compounds not requiring a developer and having a reducing capability by themselves have been developed. Typical examples are the dye providing substances described, for example, in U.S. Pat. Nos. 3,928,312, 4,053,312, 4,055,428, 4,336,322, Japanese Patent Application (OPI) Nos. 65839/84, 69839/84, 3819/78, 104343/76, *Research Disclosure,* RD No. 17465, U.S. Pat. Nos. 3,725,062, 3,728,113, 3,443,939, Japanese Patent Application (OPI) Nos. 116537/83, 179840/82, and U.S. Pat. No. 4,500,626.

Representative examples of dye providing substances which can be used in the present invention include the compounds described in U.S. Pat. No. 4,500,626 (columns 22 to 44). Of these compounds, Compounds (1) to (3), (10) to (13), (16) to (19), (28) to (30), (33) to (35), (38) to (40), and (42) to (64) are preferred. In addition, the compounds described in Japanese Patent Application (OPI) No. 124941/86 are also useful.

The above dye providing compound and hydrophobic additives such as an image formation accelerating agent and the like as described hereinafter can be incorporated in a layer of the light-sensitive element by known techniques such as the method described in U.S. Pat. No. 2,322,027. In this case, high boiling point organic solvents as described, for example, in Japanese Patent Application (OPI) Nos. 83154/84, 178451/84, 178452/84, 178453/84, 178454/84, 178455/84, and 178457/84 can be used, if desired, in combination with low boiling point organic solvents have a boiling point of from about 50° to about 160° C.

The amount of the high boiling point organic solven used is not more than about 10 g, preferably not more than 5 g, per gram of the dye providing substance.

The dispersion method using a polymer as described in Japanese Patent Publication No. 39853/76 and Japanese Patent Application (OPI) No. 59943/76 can be used.

Where the compounds are substantially insoluble in water, they can be dispersed in a binder as fine particles.

Various surface active agents can be used in dispersing hydrophobic substances in a hydrophilic colloid. Examples of the surface active agents include those described in Japanese Patent Application (OPI) No. 157636/84.

In the present invention, it is preferred that a reducing substance be incorporated in the light-sensitive element. As these reducing substances, as well as conventional reducing agents, the dye providing substances having a reducing ability can be used. In addition, reducing agent precursors not having reducing ability by themselves, but exhibiting reducing properties upon reaction with a nucleophilic reagent or subjecting to heating during the development step, can be used.

Representative examples of reducing agents which can be used in the present invention are described in U.S. Pat. 4,500,626 and 4,483,914, Japanese Patent Application (OPI) Nos. 140355/85, 128438/85, 128436/85, 128439/85, 128437/85, and so forth. In addition, reducing agent precursors described in Japanese Patent Application (OPI) Nos. 138736/81, 40245/82, and U.S. Patent 4,330,617 can be used.

Combinations of various developers as described in U.S. Pat. No. 3,039,869 can also be used.

The amount of the reducing agent added is from about 0.01 to about 20 mol, particularly preferably from 0.1 to 10 mol per mol of silver.

Furthermore, an image formation accelerating agent can be used in the light-sensitive element. The image formation accelerating agent has the following function: acceleration of the redox reaction of a silver salt oxidizing agent and a reducing agent; acceleration of reactions such as formation of a dye from the dye providing substance, decomposition of the dye, and release of a diffusible dye, and acceleration of the transfer of a dye from the light-sensitive element to the dye-fixing layer. Such image formation accelerating agents are classified into bases or their precursors, nucleophilic compounds, high boiling point organic solvents (oils), heat solvents, surface active agents, compounds having a mutual action with silver or silver ion and so forth from a viewpoint of physical and chemical functions. However, these substances generally have a plurality of functions, i.e., have some of the above acceleration effects in combination. Details are described in Japanese Patent Application (OPI) No. 93451/86.

In the present invention, various development stopping agents can be used for the purpose of obtaining a constant image irrespective of changes in the processing temperature and the processing time at the time of development.

The development stopping agent is defined as a compound which quickly neutralizes a base or reacts with the base after suitable development, thereby decreasing the base concentration in the layer and stopping development, or a compound which inhibits development by reacting with silver or a silver salt. Representative examples thereof include acid precursors releasing an acid upon heating, electrophilic compounds causing a substitution reaction with a coexisting base upon heating, and nitrogen-containing heterocyclic compounds, mercapto compounds and their precursors. These compounds are described, for example, in Japanese Patent Application (OPI) Nos. 95347/86, 192939/85, 230133/85 and 230134/85.

Compounds releasing a mercapto compound upon heating are also useful as the development stopping agents. Examples of such compounds include described, for example, in Japanese Patent Application (OPI) Nos. 67851/86, 147244/86, 124941/86, 185743/86, 182039/86, 185744/86, 184539/86, 188540/86 and 53632/86.

In the present invention, compounds stabilizing an image as long as activating developing can be used in the light-sensitive element. Preferred examples of such compounds are described in U.S. Pat. No. 4,500,626.

In the present invention, various antifoggants can be used. Examples of such antifoggants include azoles, nitrogen-containing carboxylic acids and phosphoric acids as described in Japanese Patent Application (OPI) No. 168442/84, mercapto compounds and their metal salts as described in Japanese Patent Application (OPI) No. 11636/84, and acetylene compounds.

Also, an image toning agent can be incorporated in the light-sensitive element, if desired. Representative examples thereof are described in Japanese Patent Application (OPI) No. 147244/86.

In the light-sensitive element and the dye-fixing element of the present invention, an organic or inorganic hardener can be incorporated in a photographic emulsion layer and other binder layers. Representative examples of such hardeners are described in Japanese Patent Application (OPI) Nos. 147244/86 and 157636/84. These compounds can be used alone or in combination.

A support for use in the light-sensitive element and the dye-fixing element of the present invention must be able to withstand the processing temperature. Example of the support include glass, paper, polymer films, metal and similar materials. In addition, the supports described in Japanese Patent Application (OPI) No. 147244/86 can be used.

Where a colored dye providing substance is incorporated in the light-sensitive element as used herein, it is not so essential to incorporate an anti-irradiation or anti-halation substance or various dyes in the light-sensitive element. However, filter dyes, absorbing substances and the like as described in Japanese Patent Application (OPI) No. 147244/86 and U.S. Pat. No. 4,500,626 can be incorporated.

In order to obtain a wide range of colors using the three primary colors of yellow, magenta and cyan, it is necessary for the light-sensitive element to have three silver halide emulsion layers each having sensitivity in different spectral regions.

Typical combinations of at least three light-sensitive silver halide emulsion layers having light-sensitivity in different spectral regions are described in Japanese Patent Application (OPI) No. 180550/84.

The light-sensitive element as used herein may have, if desired, emulsions layers having light-sensitivity in the same spectral region as divided into two or more layers depending on the sensitivity of the emulsion.

Moreover, the light-sensitive element may comprise various conventional additives used in heat developable light-sensitive materials, and auxiliary layers such as an antistatic layer, an electrically conductive layer, a protective layer, an intermediate layer, an anti-halation layer, a peeling layer and a matting layer, in addition to the light-sensitive emulsion layers. Examples of such additives include those described in *Research Disclosure*, RD No. 17029, pp. 9 to 15 (June 1978), Japanese Patent Application (OPI) No. 88256/86 and so forth. Specific examples thereof include a plasticizer, a sharpness improving dye, an antihalation dye, a sensitizing dye, a matting agent, a surface active agent, a fluorescent whitener, an ultraviolet absorber, a slipping agent, an antioxidant, and an anti-fading agent.

In the protective layer, an organic or inorganic matting agent is generally incorporated for the prevention of adhesion. The protective layer may further contain a mordant and an ultraviolet ray absorber. The protective layer and the intermediate layer may each be composed of two or more layers.

In the intermediate layer, a reducing agent, an ultraviolet ray absorber and a white pigment such as $TiO_2$ may be incorporated for the purpose of prevnting fading and color-mixing. The white pigment may be added not only to the intermediate layer but also to the light-sensitive emulsion layer for the purpose of increasing sensitivity.

The dye-fixing element as used herein has a least one layer containing a mordant. If the dye-fixing layer is positioned on the surface of the dye-fixing element, a protective layer may be further provided if desired.

Examples of the layer construction, the binders, the additives, and the position of the layer to which the mordant is added in the dye-fixing element are described in Japanese Patent Application (OPI) No. 147244/86.

In the dye-fixing element, as well as the above described layers, a peeling layer, a matting layer, a curl-preventing layer and other auxiliary layers can further be provided if desired.

The base and/or its precursor may be incorporated in one or more of the above layers for acceleration of dye transfer. Also a hydrophilic heat solvent, an anti-fading agent, an ultraviolet ray absorber, a slipping agent, a matting agent, an antioxidant, a dispersed vinyl compound to increase dimensional stability, a fluorescent whitening agent and the like may be contained in the layers. Representative examples of these additives are described in Japanese Patent Application (OPI) No. 88256/86.

The binder used in the above layers is preferably hydrophilic. Typical examples thereof include transparent or translucent hydrophilic colloids. More specifically, the binders referred in the light-sensitive element can be used.

An image-receiving layer which can be used in the present invention include a dye-fixing layer for use in the heat developable color light-sensitive material. Generally, the mordant used therein can be selected from mordants which are commonly used. Of these mordants, polymer mordants are particularly preferred. These polymer mordants include polymers containing a tert-amino group, polymers containing a nitrogen-containing heterocyclic ring and polymers containing a quaternary cationic group of the tert-amino group and/or the heterocyclic group. Representative examples thereof are described in Japanese Patent Application (OPI) No. 147244/86 and U.S. Pat. No. 4,500,6262.

Methods for coating the layers of the present invention such as a heat developable light-sensitive layer, a protective layer, an intermediate layer, an undercoated layer and a backing layer include those described in U.S. Pat. No. 4,500,626.

As light sources for imagewise exposure to record images in the heat developable light-sensitive element of the present invention, various radiations such as visible light can be used. For example, light sources described, for example, in Japanese Patent Application (OPI) No. 147244/86 and U.S. Pat. No. 4,500,626 can be used.

In order to accelerate dye transfer, a hydrophilic heat solvent which is solid at ordinary temperature but is melted at elevated temperatures may be incorporated in the light-sensitive element and/or the dye-fixing element. The hydrophilic heat solvent may be incorporated in any of an emulsion layer, an intermediate layer, a protective layer and a dye-fixing layer. It is preferred that the hydrophilic heat solvent be incorporated in a dye-fixing layer and/or its adjacent layer.

Examples of the hydrophilic heat solvent include compounds including a heterocyclic ring, ureas, pyridines, amides, sulfonamides, imides, alcohols and oximes.

The present invention is described in greater detail with reference to the following examples, but is not limited thereto.

Unless otherwise indicated, all parts, percentage, ratios and the like are by weight.

EXAMPLE 1

Preparation of Silver Benzotriazole Emulsion 28 g of gelatin and 13.2 g of benzotriazole were dissolved in 300 l of water. The resulting solution was stirred while maintaining at 40° C. To this solution, a solution of 17 g of silver nitrate in 100 ml of water was added over 2 minutes. This silver benzotriazole emulsion was precipitated by adjusting the pH, and an excess of salts were removed. Then the pH was adjusted to 6.30 to obtain 400 g of a silver benzotriazole emulsion.

Preparation of silver Halide Emulsion for Fifth and First Layers 600 ml of an aqueous solution containing in sodium chloride and potassium bromide and an aqueous solution of silver nitrate (prepared by dissolving 0.59 mol of silver nitrate in 600 ml of water) were added at the same tim to an aqueous gelatin solution (containing 20 g of gelatin and 3 g of sodium chloride in 1,000 ml of water and maintained at 75° C.) which was well stirred, at the same flow rate over 40 minutes. This, a monodispersed cubic silver chlorobromide emulsion (bromide: 50 mol%) having an average particle size of 0.40 μm was prepared. After water washing and desalting, 5 mg of sodium thiosulfate and 20 mg of 4-hydroxy-6-methyl-1,3,3a,7-tetrazaindene were added, and chemical sensitization was performed at 60° C. The yield of the emulsion was 600 g.

Preparation of Silver Halide Emulsion for Third Layer 600 ml of an aqueous solution containing sodium chloride and potassium bromide and an aqueous silver nitrate solution (prepared by dissolving 0.59 mol of silver nitrate in 600 ml of water) were added at the same time over 40 minutes at the same flow rate to an aqueous gelatin solution (containing 20 g of gelatin and 3 g of sodium chloride in 1,000 ml of water and maintained at 75° C.) which was well stirred. Thus, a monodispersed cubic silver chlorobromide emulsion (bromide: 80 mol%) having an average particle size of 0.35 μm was prepared. After water washing and desalting, 5 mg of sodium thiosulfate and 20 mg of 4-hydroxy-6-methyl-1,3,3a,7-tetrazaindene were added, and chemical sensitization was performed at 60° C. The yield of the emulsion was 600g.

Preparation of Gelatin Dispersion of Dye Providing Substance 5 g of Yellow Dye Providing Substance (A), 0.5 g of sodium succinic acid-2-ethyl-hexylester sulfonate as a surface active agent and 2.5 g of triisononyl phosphate were dissolved in 30 ml of ethyl acetate by heating at about 60° C. to form a uniform solution. This solution and 100 g of a 3% aqueous solution of lime-treated gelatin were mixed and stirred, and dispersed by the use of a homogenizer for 10 minutes at 10,000 rpm. This dispersion is referred to as Dispersion of Yellow Dye Providing Substance.

Dispersion of Magenta Dye Providing Substance was prepared in the same manner as above except that Magenta Dye Providing Substance (B) and 2.5 g of tricresyl phosphate as a high boiling solvent were used.

Dispersion of Cyan Dye Providing Substance was prepared in the same manner as in the preparation of Dispersion of Yellow Dye Providing Substance except that Cyan Dye Providing Substance (C) was used.

Color light-sensitive elements Samples Nos. 101 to 107 having the multi-layer structure as shown in Table 1 below were prepared while changing the type and amount of the surface active agent to be added to the protective layer. In these light-sensitive elements, a hardener was added in an amount of 2 wt% based on the total weight of gelatin.

TABLE 1

| | Coated Amount |
|---|---|
| Sixth Layer: Protective Layer | |
| Gelatin | 800 mg/m$^2$ |
| Hardener *3 | 16 mg/m$^2$ |
| Silica *5 | 100 mg/m$^2$ |
| Surface active agent *6 | shown in Table 3 |
| Fifth Layer: Green-sensitive Emulsion Layer | |
| Silver chlorobromide emulsion (bromide: 50 mol %) | 400 mg/m$^2$ (as silver) |
| Silver benzotriazole emulsion | 100 mg/m$^2$ (as silver) |
| Sensitizing Dye D-1 | $10^{-6}$ mol/m$^2$ |
| Hardener *3 | 20 mg/m$^2$ |
| Yellow Dye Providing Substance (A) | 400 mg/m$^2$ |
| Gelatin | 1,000 mg/m$^2$ |
| High boiling point solvent *4 | 200 mg/m$^2$ |
| Surface Active Agent *2 | 100 mg/m$^2$ |
| Fourth Layer: Intermediate Layer | |
| Gelatin | 900 mg/m$^2$ |
| Hardener *3 | 18 mg/m$^2$ |
| Zinc hydroxide | 500 mg/m$^2$ |
| Third Layer: Red-Sensitive Emulsion Layer | |
| Silver chlorobromide emulsion (bromide: 80 mol %) | 300 mg/m$^2$ (as silver) |
| Silver benzotriazole emulsion | 100 mg/m$^2$ (as silver) |
| Sensitizing Dye D-2 | $8 \times 10^{-7}$ mol/m$^2$ |
| Hardener *3 | 20 mg/m$^2$ |
| Magenta Dye Providing Substance (B) | 400 mg/m$^2$ |
| Gelatin | 1,000 mg/m$^2$ |
| High boiling point solvent *1 | 200 mg/m$^2$ |
| Surface Active Agent *2 | 100 mg/m$^2$ |
| Second Layer: Intermediate Layer | |
| Gelatin | 800 mg/m$^2$ |
| Hardener *3 | 16 mg/m$^2$ |
| Zinc hydroxide | 500 mg/m$^2$ |
| First Layer: Infrared Sensitive Emulsion Layer | |
| Silver chlorobromide emulsion (bromide: 50 mol %) | 300 mg/m$^2$ (as silver) |
| Silver benzotriazole emulsion | 100 mg/m$^2$ (as silver) |
| Sensitizing Dye D-3 | $10^{-8}$ mol/m$^2$ |
| Hardener *3 | 20 mg/m$^2$ |
| Cyan Dye Providing Substance (C) | 300 mg/m$^2$ |
| Gelatin | 1,000 mg/m$^2$ |
| High boiling point solvent *4 | 150 mg/m$^2$ |
| Surface Active Agent *2 | 100 mg/m$^2$ |
| Support: | |
| Polyethyleneterephthalate (thickness: 100 μm) | |

*1: Tricresyl phosphate

*2:

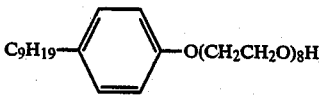

*3: 2,4-Dichloro-6-hydroxy-1,3,5-triazine
*4: $(isoC_9H_{19}O)_3P{=}O$
*5: Average particle size: 4 μm Dye Providing Substance (A)

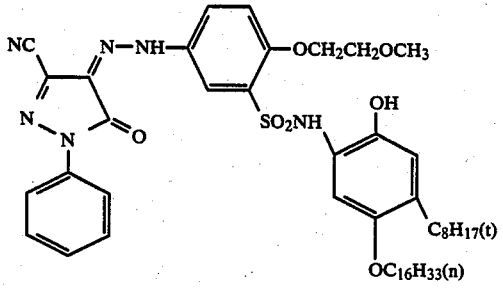

Dye-Providing Substance (B)

TABLE 1-continued

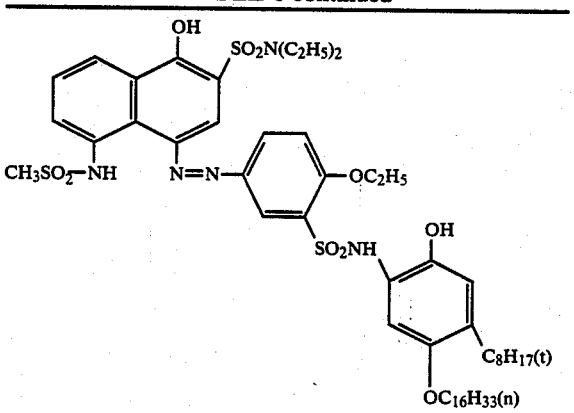

Dye-Providing Substance (C)

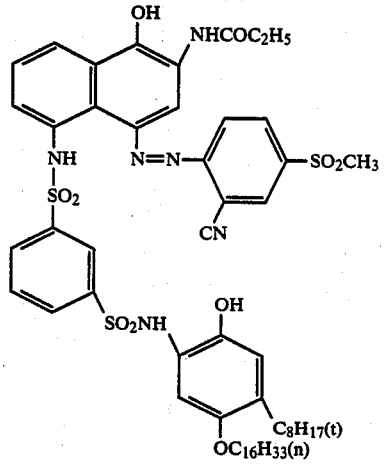

Sensitizing Dye (D-1)

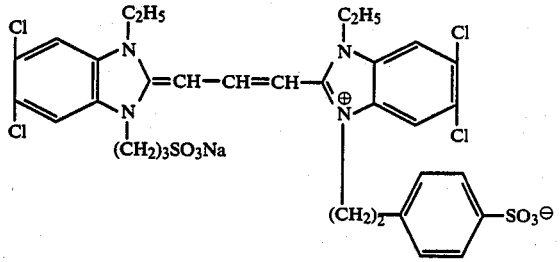

Sensitizing Dye (D-2)

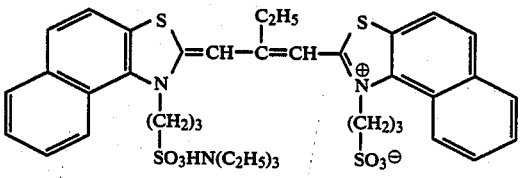

Sensitizing Dye (D-3)

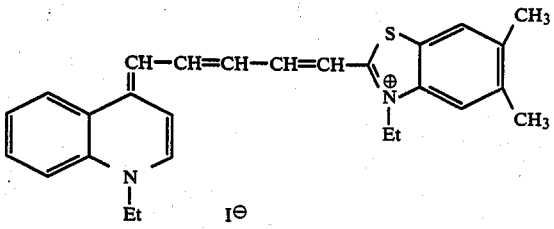

A dye-fixing element was prepared by providing the layers shown in the Table 2 below on a polyethylene laminated paper support.

TABLE 2

| | Coated Amount |
|---|---|
| Second Layer | |
| Gelatin | 0.7 g/m$^2$ |
| Hardener *1 | 0.24 g/m$^2$ |
| First Layer | |
| Gelatin | 1.4 mg/m$^2$ |
| Mordant *2 | 2.6 g/m$^2$ |
| Picolic acid guanidium salt | 2.5 g/m$^2$ |

*1: 1,2-Bis(vinylsulfonylacetamido)ethane

*2:

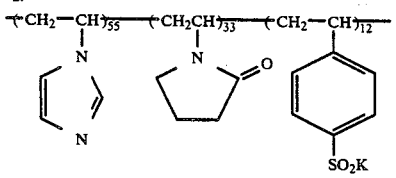

The above-prepared multi-layer structure color light-sensitive element was exposed to light rough a G, R, IR three color separation filter having continuously changing density (produced with a band pass filter of 500 to 600 nm for G, a band pass filter of 600 to 700 nm for R and a filter passing more than 700 nm for IR) at 500 lux for 1 second by the use of a tungsten lamp.

5 ml/m$^2$ of water was supplied to the emulsion surface of the above exposed light-sensitive element by the use of a wire are, and then the dye-fixing element was superposed thereon in such a manner that the coated layers were in contact with each other.

The elements were heated for 20 seconds with a heat roller which was controlled in temperature so that the temperature of the water absorbed coated layers was 90° to 95° C. Then the dye-fixing element was peeled apart from the light-sensitive element, and peeling properties and photographic performance were measured. The results are shown in Table 3.

Method for Evaluation of Peeling Properties

The peeling properties were determined as follows:

(1) How much relative force was needed to peel the elements apart.

(2) Visual observation of the surface of the dye-fixing element after peeling to determine whether the coated layers peeled apart, and whether the coated layers of the light-sensitive element were damaged.

TABLE 3

| Sample No. | Amphoteric Surface Active Agent Added to Protective Layer | Coated Amount (mg/m$^2$) | Maximum Density Yellow | Maximum Density Magenta | Maximum Density Cyan | Minimum Density Yellow | Minimum Density Magenta | Minimum Density Cyan | Peeling Properties |
|---|---|---|---|---|---|---|---|---|---|
| 101 | — | — | 2.25 | 2.26 | 2.43 | 0.10 | 0.10 | 0.12 | Not peeled |
| 102 | Compound 2 | 0.5 | 2.25 | 2.27 | 2.45 | 0.10 | 0.10 | 0.11 | A great force was needed in peeling, and the coating was partially damaged. |
| 103 | Compound 2 | 1 | 2.23 | 2.24 | 2.41 | 0.09 | 0.10 | 0.13 | A great force was needed in peeling. No damage. |
| 104 | Compound 2 | 5 | 2.27 | 2.25 | 2.44 | 0.11 | 0.09 | 0.12 | Relatively easy peeling. No damage |
| 105 | Compound 2 | 50 | 2.26 | 2.28 | 2.42 | 0.10 | 0.11 | 0.11 | Easy peeling. No damage |
| 106 | Compound 1 | 50 | 2.29 | 2.26 | 2.46 | 0.10 | 0.10 | 0.13 | Easy peeling. No damage |
| 107 | Compound 10 | 50 | 2.24 | 2.27 | 2.42 | 0.10 | 0.09 | 0.12 | Easy peeling. No damage. |

Sample No. 101: Comparative Example
Sample Nos. 102 to 106: Examples of the present invention As apparent from the results shown in Table 3, in the light-sensitive elements Sample Nos. 102 to 107 according to the present invention, the dye-fixing element could be peeled apart and neither serious damage nor contamination was observed in the peeled surface, and thus a sharp image was obtained. Particularly, in Sample Nos. 105 to 107, the elements could be peeled easily with a little force, and no damage was observed in the peeled surface.

However, in the light-sensitive material Sample No. 101, the dye-fixing element was adhered to the light-sensitive element and could not be peeled apart therefrom. If the dye-fixing element was forcedly peeled apart, the coated layers were also peeled apart and no satisfactory image was obtained.

EXAMPLE 2

A light-sensitive material having the layer structure as shown in Table 4 was prepared in the same manner as in Example 1.

TABLE 4

| | Coated Amount |
|---|---|
| Seventh Layer: First Protective Layer | |
| Gelatin | 800 mg/m$^2$ |
| Water-soluble polymer *7 | 400 mg/m$^2$ |
| Hardener *3 | 10 mg/m$^2$ |
| Surface active agent | shown in Table 5 |
| Silica *5 | 100 mg/m$^2$ |
| Sixth Layer: Second Protective Layer | |
| Gelatin | 400 mg/m$^2$ |
| Hardener *3 | 10 mg/m$^2$ |
| Fifth Layer: Green-sensitive Emulsion Layer | |
| Silver chlorobromide emulsion (bromide: 50 mol %) | 400 mg/m$^2$ (as silver) |
| Silver acetylene emulsion | 100 mg/m$^2$ (as silver) |
| Sensitizing Dye D-1 | $10^{-6}$ mol/m$^2$ |
| Hardener *3 | 16 mg/m$^2$ |
| Surface active agent | shown in Table 5 |
| Yellow Dye Providing Substance (A) | 400 mg/m$^2$ |

TABLE 4-continued

| | Coated Amount |
|---|---|
| Gelatin | 1,000 mg/m² |
| High boiling point solvent *4 | 200 mg/m² |
| Surface active agent *2 | 100 mg/m² |
| Fourth Layer: Intermediate Layer | |
| Gelatin | 700 mg/m² |
| Hardener *3 | 18 mg/m² |
| Zinc hydroxide *6 | 300 mg/m² |
| Third Layer: Red-Sensitive Emulsion Layer | |
| Silver chlorobromide emulsion (bromide: 80 mol %) | 300 mg/m² (as silver) |
| Silver acetylene emulsion | 100 mg/m² (as silver) |
| Sensitizing Dye D-2 | $8 \times 10^{-7}$ mol/m² |
| Hardener *3 | 18 mg/m² |
| Magenta Dye Providing Substance (B) | 400 mg/m² |
| Gelatin | 1,000 mg/m² |
| High boiling point solvent *1 | 200 mg/m² |
| Surface Active Agent *2 | 100 mg/m² |
| Second Layer: Intermediate Layer | |
| Gelatin | 800 mg/m² |
| Hardener *3 | 16 mg/m² |
| Zinc hydroxide *6 | 300 mg/m² |
| First Layer: Infrared Sensitive Emulsion Layer | |
| Silver chlorobromide emulsion (bromide: 50 mol %) | 300 mg/m² (as silver) |
| Silver benzotriazole emulsion | 100 mg/m² (as silver) |
| Sensitizing Dye D-3 | $10^{-8}$ mol/m² |
| Hardener *3 | 16 mg/m² |
| Cyan Dye Providing Substance (C) | 300 mg/m² |
| Gelatin | 1,000 mg/m² |
| High boiling point solvent *4 | 150 mg/m² |
| Surface Active Agent *2 | 100 mg/m² |
| Support: | |
| Polyethyleneterephthalate (thickness: 100 μm) | |

*1: Tricresyl phosphate

*2:

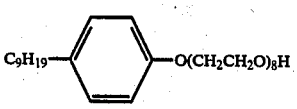

*3: 1,2-Bis(vinylsulfonylacetamido)ethane

*4: $(iso C_9H_{19}O)_3P{=}O$

*5: Average particle size: 3 to 5 μm

*6: Average particle size: 0.2 to 0.3 μm

*7: Water-soluble polymer $$-(CH_2-\underset{\substack{|\\ CONH(CH_3)_2CH_2SO_3Na}}{CH})_n-$$

Dye Providing Substances (A), (B) and (C), and Sensitizing Dyes D-1, D-2 and D-3 are shown hereinbefore.

The above-prepared multi-layer structure color light-sensitive element was exposed to light in the same manner as in Example 1, and then 12 ml/m² or 18 ml/m² of water was applied to the emulsion surface by the use of a wire bar. Thereafter, the same procedure as in Example 1 was repeated using the same dye-fixing element as used in Example 1, whereupon yellow, magenta and cyan images were obtained. The density of each color was measured by the use of a Macbeth densitometer (Model RD-519). When the amount of water supplied was 12 ml/m², the exposure amount was determined so that the density of each color was 1.0. When the amount of water supplied was 18 ml/m², the density was measured at the same exposure amount as above. The results are shown in Table 5.

TABLE 5

| Sample No. | Amphoteric Surface Active Agent No. | Addition Amount (mg/m²) 7th Layer | Addition Amount (mg/m²) 5th Layer | Density at 18 ml/m² of water Yellow | Magenta | Cyan |
|---|---|---|---|---|---|---|
| 201 | — | — | — | 0.52 | 0.84 | 0.98 |
| 202 | Compound 1 | 50 | — | 0.84 | 0.89 | 0.99 |
| 203 | Compound 2 | 50 | — | 0.82 | 0.90 | 0.97 |
| 204 | Compound 10 | 50 | — | 0.78 | 0.90 | 0.98 |
| 205 | Compound 24 | 50 | — | 0.76 | 0.88 | 0.98 |
| 206 | Compound 2 | — | 50 | 0.89 | 0.91 | 0.98 |

It can be seen from the results shown in Table 5 that when the surface active agents of the present invention are used, even if the amount of water supplied to the light-sensitive material varies, the extent of variation in image density can be decreased and thus a stable image can be obtained.

It can also be seen from the results of Sample No. 206 that a great effect can be obtained not only when the amphoteric surface active agent is added to the uppermost layer but also when it is added to a lower layer (e.g., the fifth layer).

EXAMPLE 3

A dye-fixing material shown in Table 6 was prepared in place of the dye-fixing material of Example 1.

TABLE 6

| | Coated Amount No. R-1 | R-2 |
|---|---|---|
| Second Layer | | |
| Gelatin | 0.7 g/m² | 0.7 g/m² |
| Hardener *1 | 0.24 g/m² | 0.24 g/m² |
| Amphoteric Surface Active Agent | none | Compound 24 0.18 g/m² |
| First Layer | | |
| Gelatin | 1.4 g/m² | 1.4 g/m² |
| Mordant *2 | 2.6 g/m² | 2.6 g/m² |
| Guanadium picolate | 2.5 g/m² | 2.5 g/m² |

Support: Polyethylene laminated paper.

*1, *2: Same as in Example 1

Using the light-sensitive element in Example 2 and the dye fixing element R-1 or R-2 in combination, the same procedure as in Example 2 was conducted. When the dye-fixing element R-2 was used, nearly the same results as in Sample No. 205 were obtained when the amount of water supplied was 18 ml/m². It can be seen that the amphoteric surface active agent is also effective when it was added to the dye-fixing element.

EXAMPLE 4

The dye-fixing elements R-1 and R-2 of Example 3 were stored for 2 weeks under conditions of 25° C. and 10% RH. Then, using the light-sensitive material Sample No. 201, the same procedure as in Example 2 was conducted. In the case of the dye-fixing element R-1, many white dots were observed, whereas in the case of R-2, the number of white dots was markedly decreased. These results show that the amphoteric surface active agents are also effective in preventing the formation of white dots.

In accordance with the present invention, peeling properties between the light-sensitive element and the dye-fixing element after heat development and diffusion transfer of dyes are greatly improved. Thus, the dye-fixing element can be easily peeled apart from the light-sensitive element, and with no damage or contamination of the peeled surface, and a sharp image can be obtained.

While the invention has been described in detail and with reference to specific embodiments thereof, it will be apparent to one skilled in the art that various changes and modifications can be made therein without departing from the spirit and scope thereof.

What is claimed is:

1. A method for forming an image comprising heating a light-sensitive element in the presence of water and at least one of base and a base precursor after or simultaneously with imagewise exposure to light thereof, said light-sensitive element comprising support having provided thereon a light-sensitive layer comprising a light-sensitive silver halide emulsion, a binder, and a dye providing substance which forms or releases a diffusible dye upon heating, and transferring said diffusible dye thus formed or released to a dye fixing layer of a dye fixing element, wherein at least one of said light-sensitive element and said dye fixing element contains an amphoteric surface active agent, wherein said water is supplied from exterior the light-sensitive element and the dye fixing element and is supplied in an amount of from 0.1× the weight of all layers comprising the light-sensitive element and the dye fixing element to the weight of water corresponding to the maximum swelling volume of all the layers in the light-sensitive element and dye fixing element.

2. A method for forming an image as in claim 1, wherein said amphoteric surface active agent contains an unsubstituted or fluorine-substituted saturated or unsaturated hydrocarbon moiety having 6 or more of carbon atoms.

3. A method for forming an image as in claim 2, wherein said amphoteric surface active agent contains an unsubstituted or fluorine-substituted saturated or unsaturated hydrocarbon moiety having from 10 to 24 carbon atoms.

4. A method for forming an image as in claim 1, wherein said amphoteric surface active agent is contained in said dye fixing element.

5. A method for forming an image as in claim 1, wherein total content of said amphoteric surface active agent in both said light-sensitive element and said dye fixing element is 0.001 $g/m^2$ or more.

6. A method for forming an image as in claim 5, wherein total content of said amphoteric surface active agent in both said light-sensitive element and said dye fixing element is 0.005 $g/m^2$ to 5 $g/m^2$.

7. A method for forming an image as in claim 1, wherein said amphoteric surface active agent is contained in the uppermost layer of at least one of said light-sensitive element and said dye fixing element.

8. A method for forming an image as in claim 1, wherein said base precursor comprises a combination of a sparingly water-soluble basic metal compound and a compound capable of reacting with the metal ion of said sparingly water-soluble basic metal compound.

* * * * *